US007900291B2

(12) United States Patent
Ma et al.

(10) Patent No.: US 7,900,291 B2
(45) Date of Patent: Mar. 8, 2011

(54) BLOWER SYSTEM FOR HEALTH BOOTH

(76) Inventors: Yen-Ping Ma, Taichung (TW); Yen-Chung Ma, Taichung (TW)

( * ) Notice: Subject to any disclaimer, the term of this patent is extended or adjusted under 35 U.S.C. 154(b) by 907 days.

(21) Appl. No.: 11/777,272

(22) Filed: Jul. 12, 2007

(65) Prior Publication Data

US 2009/0013459 A1 Jan. 15, 2009

(51) Int. Cl.
*A61H 33/06* (2006.01)

(52) U.S. Cl. ..... 4/524

(58) Field of Classification Search ..... 4/524, 535–537
See application file for complete search history.

(56) References Cited

U.S. PATENT DOCUMENTS 5,099,587 A * 3/1992 Jarosch ..... 34/202
6,148,539 A * 11/2000 Hatfield et al. ..... 34/223
7,013,504 B2 * 3/2006 Brunelle et al. ..... 4/597

* cited by examiner

*Primary Examiner* — Huyen Le

(57) ABSTRACT

A blower system in a booth including a hollow base, an internal space, and an air outlet is disclosed and includes at least one blower assembly in the base, each blower assembly including a heating element and a motor driven fan; and a pipe assembly communicating with both the base and the space. In response to activating the at least one blower assembly, the fan of each blower assembly is adapted to blow ambient air past the hot heating element for heating the air, and the hot air is adapted to enter the space through the pipe assembly. An occupant can relax in a heat environment.

7 Claims, 5 Drawing Sheets

BLOWER SYSTEM FOR HEALTH BOOTH

BACKGROUND OF THE INVENTION

1. Field of Invention

The invention relates to blowers and more particularly to a blower system including one or more blower assemblies including a motor driven fan and a heating element and being mounted in the base of a health booth for providing a heat environment to an occupant.

2. Description of Related Art

Steam shower rooms such as sauna or Turkish baths are popular throughout the world. Further, for example, a booth shaped sauna is also available for home or portable use. One type of conventional steam booth is provided with an ambient air inlet on the base for drawing cold air thereinto and a top air outlet for escaping steam. One drawback of the conventional steam booth is that the air inlet is provided directly below the occupant and thus a nude occupant tends to get cold due to direct cold air blowing thereto.

There have been numerous suggestions in prior patents for steam booth. For example, U.S. Pat. No. 5,416,931 discloses a collapsible booth. Thus, continuing improvements in the exploitation of health booth including steam booth having an improved blower system are constantly being sought.

SUMMARY OF THE INVENTION

It is therefore one object of the invention to provide a blower system in a booth including a hollow base, an internal space, and an air outlet, the blower system comprising at least one blower assembly in the base, each blower assembly including a heating element and a motor driven fan; and pipe means communicating with both the base and the space. In response to activating the at least one blower assembly, the fan of each of the at least one blower assembly is adapted to blow ambient air past the hot heating element for heating the air, and the hot air is adapted to enter the space through the pipe means. By utilizing this blower system, an occupant can relax in a heat environment.

The above and other objects, features and advantages of the invention will become apparent from the following detailed description taken with the accompanying drawings.

DETAILED DESCRIPTION OF THE INVENTION

Figure 1:
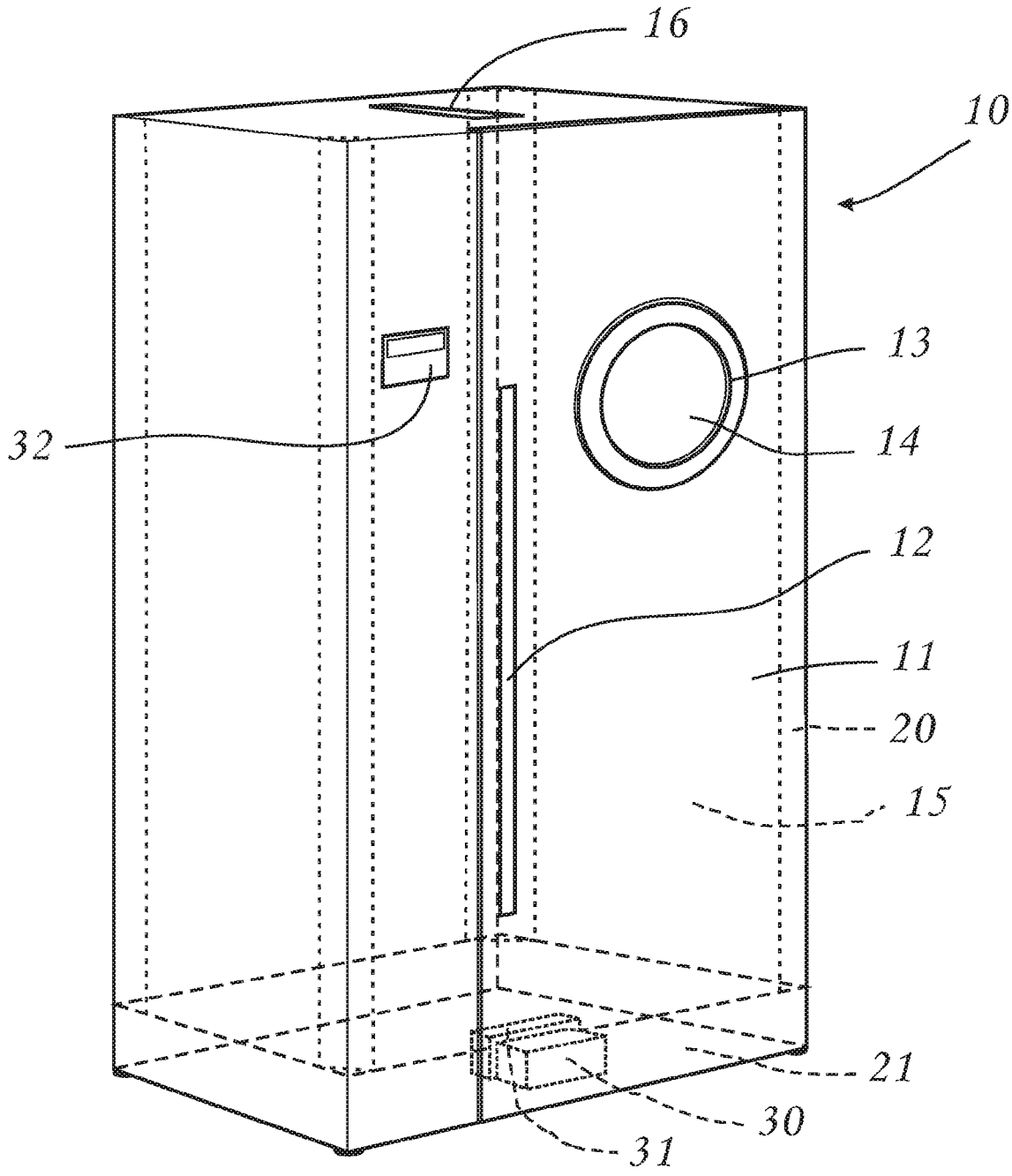
FIG. 1 is a perspective schematic view of a health booth incorporating a first preferred embodiment of blower system according to the invention.
Figure 2:
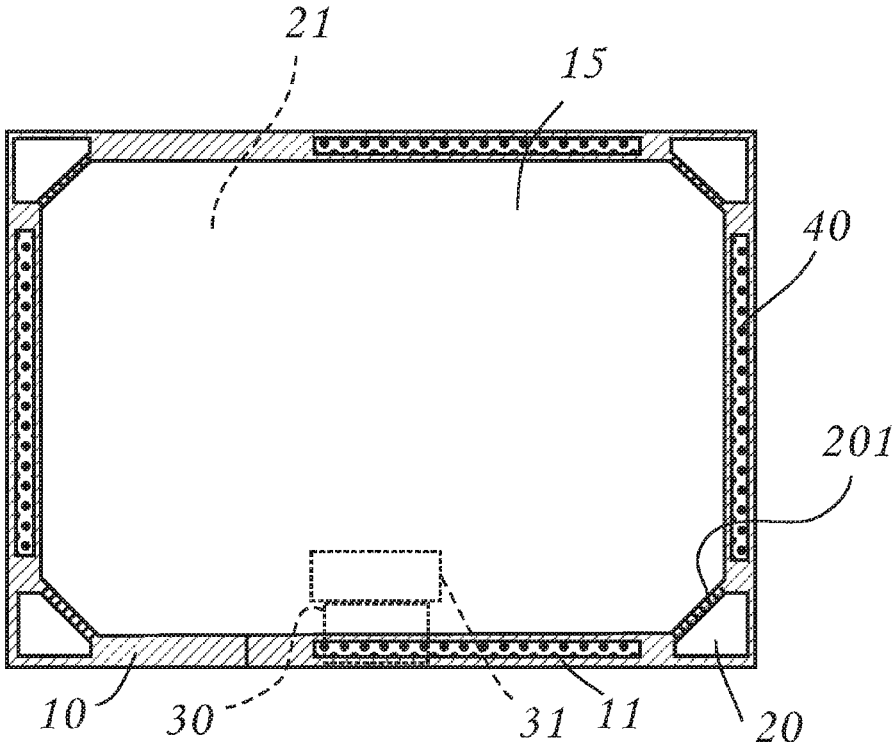
FIG. 2 is a cross-sectional view of the base of FIG. 1.

Referring to FIGS. 1 and 2, a health booth incorporating a blower system in accordance with a first preferred embodiment of the invention is shown at 10. The booth 10 is rectangular in section and comprises a front door 11, a handle 12 at one edge of the door 11 for opening or closing the door 11, an opening 13 on the door 11 and being disposed to the right of an upper portion of the handle 12 with a glass window 14 fitted therein, an internal space 15, an air outlet 16 on the roof, a hollow base 21 in communication with the atmosphere and separated from the space 15, four upright channels 20 at four corners of the booth housing, each channel 20 having a bottom end in communication with the base 21 and including a plurality of holes (not numbered) in communication with the space 15, a heatproof unit 40 at each of four side walls, a blower arrangement provided in the base 21 and including a motor driven fan 30 and a heating element 31, and an on/off switch 32 on the booth housing and being disposed to the left of the upper portion of the handle 12.

In use, an occupant turns on the switch 32 to activate the blower arrangement. The fan 30 thus rotates in high speed to blow ambient air past hot coils of wire of the heating element 31. As such, the air is heated. The hot air then flows to the channels 20 prior to entering the space 15 through the holes. As an end, the occupant can relax in a heat environment.

The air outlet 16 is adapted to escape hot air. Also, both rotation speed of the fan 30 and temperature of the heating element 31 can be controlled by a control device well known in the art.

As shown in FIG. 2 specifically, the blower arrangement comprises only one blower assembly having a fan 30 and a heating element 31 and the blower arrangement is provided at a front end of the base 21.

Figure 3:
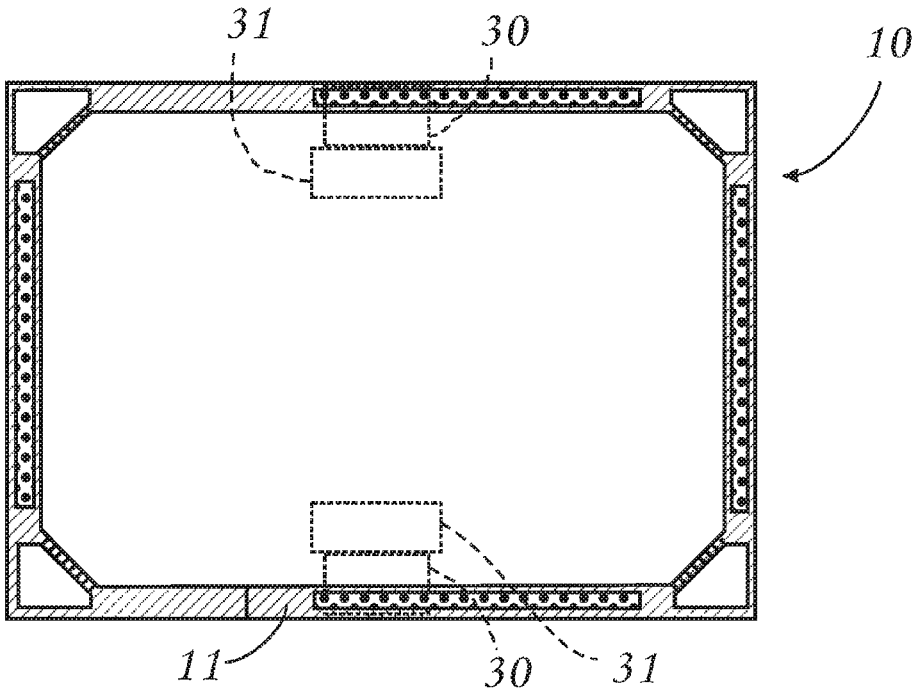
FIG. 3 is a view similar to FIG. 2 showing a second preferred embodiment of blower system according to the invention.

Referring to FIG. 3, a second preferred embodiment of blower system according to the invention is shown. The blower arrangement of the blower system comprises two opposite blower assemblies having a fan 30 and a heating element 31 in which one blower assembly is provided at a front end of the base 21 and the other blower assembly is provided at a rear end of the base 21.

Figure 4:
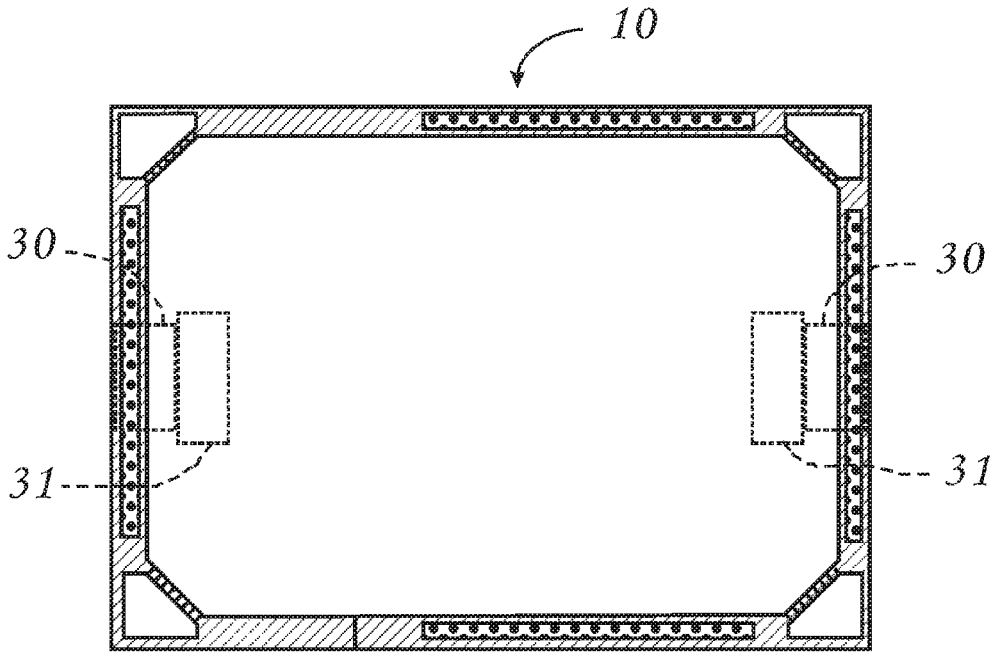
FIG. 4 is a view similar to FIG. 2 showing a third preferred embodiment of blower system according to the invention.

Referring to FIG. 4, a third preferred embodiment of blower system according to the invention is shown. The blower arrangement of the blower system comprises two opposite blower assemblies having a fan 30 and a heating element 31 in which one blower assembly is provided at a left side of the base 21 and the other blower assembly is provided at a right side of the base 21.

Figure 5:
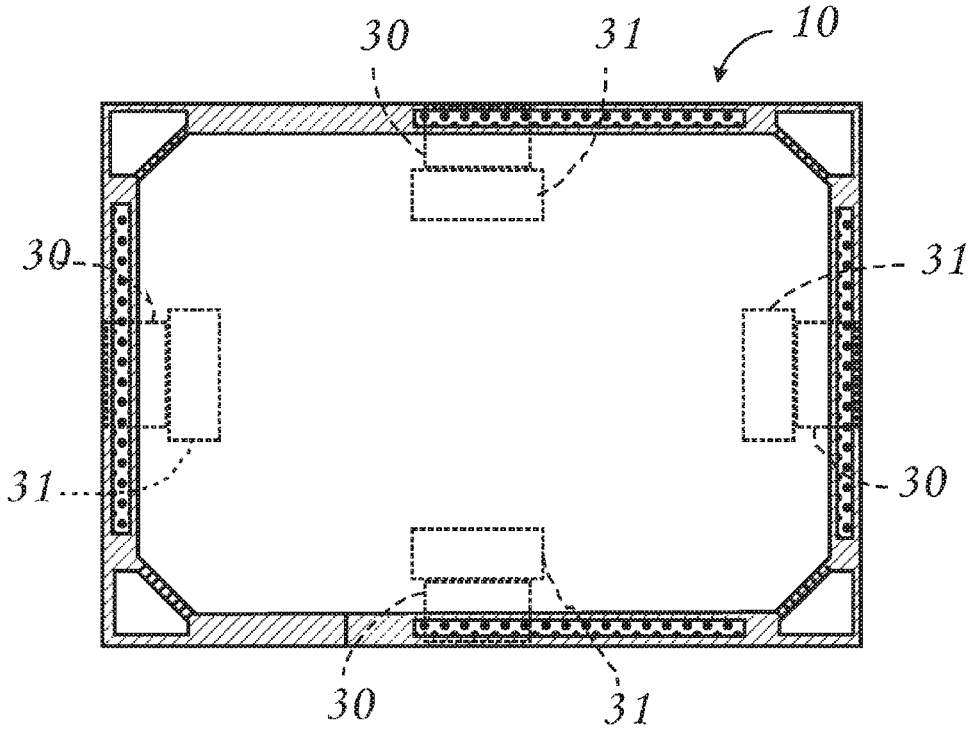
FIG. 5 is a view similar to FIG. 2 showing a fourth preferred embodiment of blower system according to the invention.

Referring to FIG. 5, a fourth preferred embodiment of blower system according to the invention is shown. The blower arrangement of the blower system comprises four blower assemblies having a fan 30 and a heating element 31 in which a first blower assembly is provided at a front end of the base 21, a second blower assembly is provided at a rear end of the base 21, a third blower assembly is provided at a left side of the base 21, and a fourth blower assembly is provided at a right side of the base 21.

Figure 6:
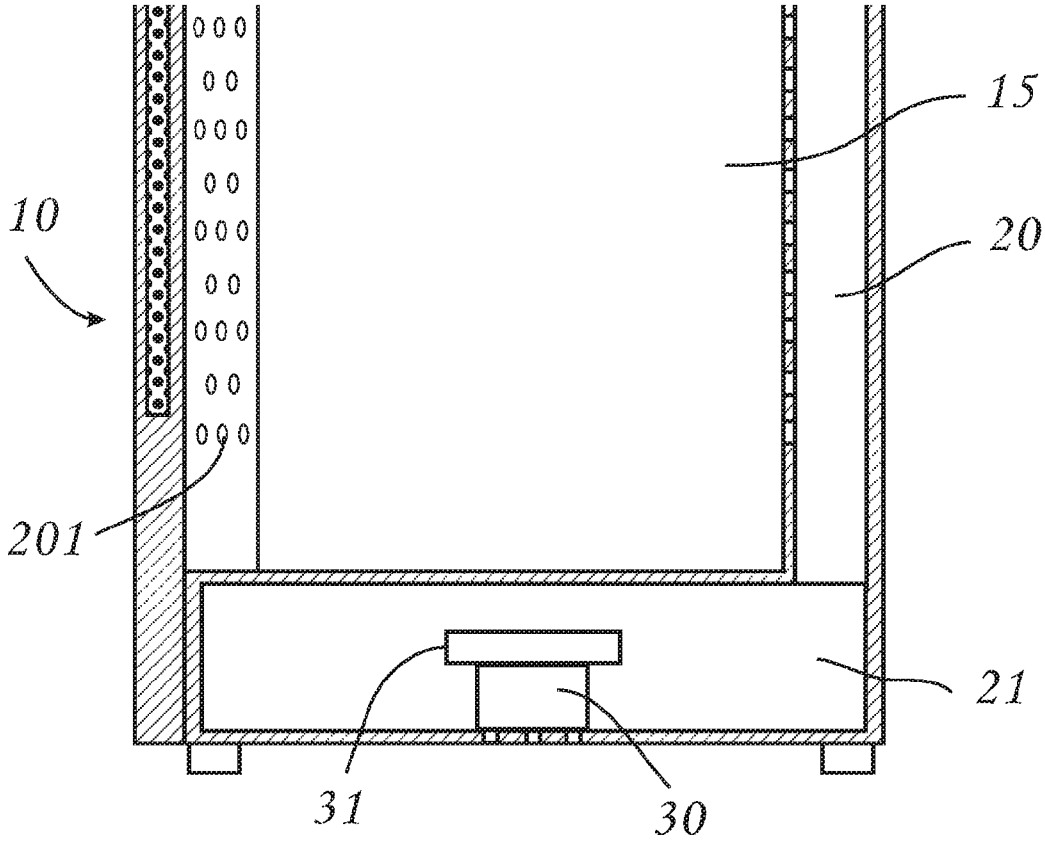
FIG. 6 is a longitudinal sectional view of a portion of health booth incorporating a fifth preferred embodiment of blower system according to the invention.
Figure 7:
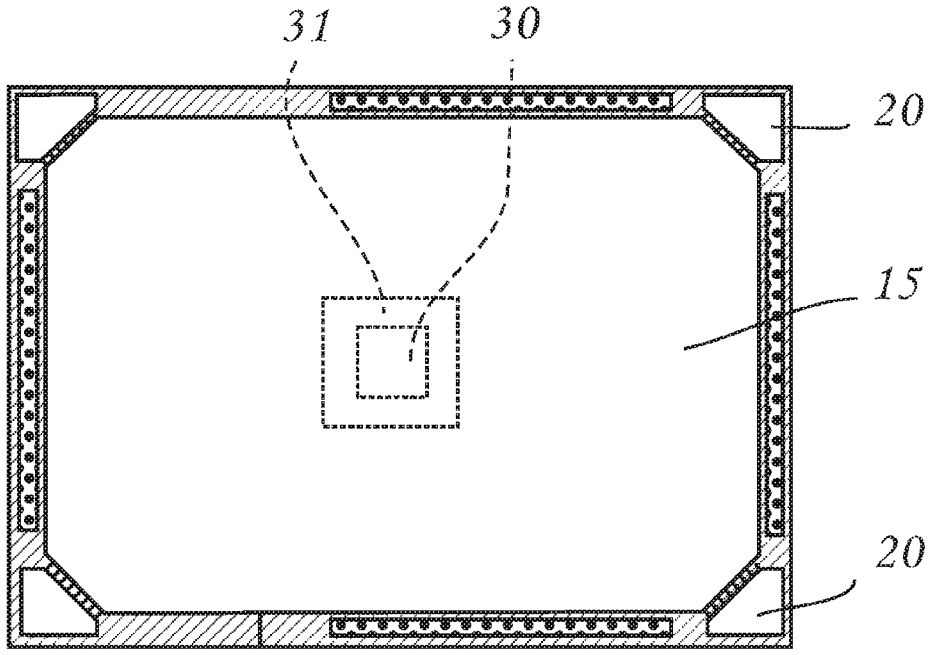
FIG. 7 is a cross-sectional view of the base of FIG. 6 showing the location of the blower arrangement.

Referring to FIGS. 6 and 7, a fifth preferred embodiment of blower system according to the invention is shown. The blower arrangement of the blower system comprises only on blower assembly having a fan 30 and a heating element 31 and the blower arrangement is provided in a center of the base 21. Moreover, each channel 20 includes a plurality of holes 201 in communication with the space 15.

Figure 8:
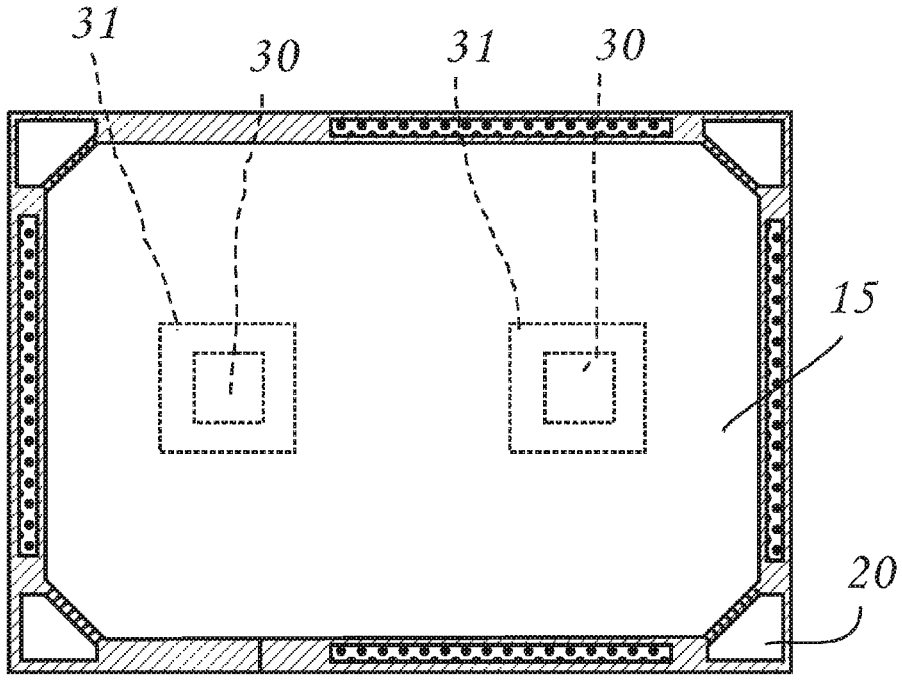
FIG. 8 is a view similar to FIG. 7 showing a sixth preferred embodiment of blower system according to the invention.

Referring to FIG. 8, a sixth preferred embodiment of blower system according to the invention is shown. The blower arrangement of the blower system comprises two spaced blower assemblies having a fan 30 and a heating element 31 in which one blower assembly is provided about between a center of the base and the left side thereof, and the other blower assembly is provided about between the center of the base and the right side thereof.

While the invention herein disclosed has been described by means of specific embodiments, numerous modifications and variations could be made thereto by those skilled in the art without departing from the scope and spirit of the invention set forth in the claims.

What is claimed is:

1. A blower system mountable in a booth including a hollow base in communication with the atmosphere, a housing for defining an internal space which is adapted to accommodate at least one person, and an air outlet on the housing for communicating with the atmosphere, comprising:

at least one blower assembly in the base, each blower assembly including a heating element and a motor driven fan; and at least one pipe having one end in communication with the base and the other end in communication with the space, wherein in response to activating the at least one blower assembly, the fan of each of the at least one blower assembly is adapted to blow ambient air past the hot heating element for heating the air, and the hot air is adapted to enter the space through the at least one pipe.

2. The blower system of claim 1, wherein the base is rectangular.

3. The blower system of claim 2, wherein the number of the blower assembly is one, and wherein the blower assembly is located either at a front end of the base or at a center of the base.

4. The blower system of claim 2, wherein the number of the blower assembly is two, and wherein one blower assembly is mounted at a front end of the base and the other blower assembly is mounted at a rear end of the base.

5. The blower system of claim 2, wherein the number of the blower assembly is two, and wherein one blower assembly is mounted at one side of the base and the other blower assembly is mounted at the other side of the base.

6. The blower system of claim 2, wherein the number of the blower assembly is four, and wherein a first blower assembly is mounted at a front end of the base, a second blower assembly is mounted at a rear end of the base, a third blower assembly is mounted at one side of the base, and a fourth blower assembly is mounted at the other side of the base.

7. The blower system of claim 2, wherein the number of the blower assembly is two, and wherein one blower assembly is mounted between a center of the base and one side of the base, and the other blower assembly is mounted between the center of the base and the other side of the base.

* * * * *